US005690400A

United States Patent [19]

Tryon

[11] Patent Number: 5,690,400

[45] Date of Patent: *Nov. 25, 1997

[54] CABINET ASSEMBLY COMPRISING MULTIPLE IDENTICAL MOLDED CABINET UNITS

[75] Inventor: John Frederick Tryon, Houston, Tex.

[73] Assignee: Shell Oil Company, Houston, Tex.

[ * ] Notice: The term of this patent shall not extend beyond the expiration date of Pat. Nos. 5,688,031 and 5,688,032.

[21] Appl. No.: 533,418

[22] Filed: Sep. 25, 1995

Related U.S. Application Data

[63] Continuation-in-part of Ser. No. 473,686, Jun. 7, 1995, Pat. No. 5,688,032, which is a continuation-in-part of Ser. No. 435,052, May 8, 1995, Pat. No. 5,688,031.

[51] Int. Cl.[6] ..... A47B 81/00

[52] U.S. Cl. ..... 312/107; 312/257.1; 312/138.1; 312/198; 312/265.6

[58] Field of Search ..... 312/116, 218, 312/400, 401, 351, 140.1, 278, 138.1

[56] References Cited

U.S. PATENT DOCUMENTS

| | | | |
|---|---|---|---|
| 2,489,493 | 11/1949 | Kuenzie . | |
| 2,526,989 | 10/1950 | Wyman | 312/400 |
| 2,556,099 | 6/1951 | Myer | 312/400 X |
| 2,645,096 | 7/1953 | Kuhn | 312/116 X |
| 2,710,241 | 6/1955 | Lieberman | 312/351 |
| 2,894,604 | 7/1959 | McMillan | 312/140.1 X |
| 2,933,360 | 4/1960 | Sitler | 312/140.1 X |
| 3,085,842 | 4/1963 | Johnson . | |
| 3,297,373 | 1/1967 | Andrews et al. . | |
| 3,542,444 | 11/1970 | Webb et al. . | |
| 3,847,250 | 11/1974 | Sherrill . | |
| 3,847,458 | 11/1974 | Nowak . | |
| 3,853,367 | 12/1974 | Jamison et al. . | |
| 3,897,855 | 8/1975 | Patterson | 312/278 X |
| 3,961,456 | 6/1976 | Manlove et al. | 52/716 |
| 4,073,556 | 2/1978 | Wilson, Jr. | 312/138.1 X |
| 4,155,611 | 5/1979 | Brekke et al. . | |
| 4,696,954 | 9/1987 | Pritchard et al. . | |
| 4,790,610 | 12/1988 | Welch et al. | 312/218 |
| 5,106,173 | 4/1992 | Kelley et al. . | |
| 5,123,564 | 6/1992 | Hobson . | |
| 5,194,482 | 3/1993 | Chundury et al. . | |
| 5,215,367 | 6/1993 | Montuoro et al. | 312/401 |
| 5,344,030 | 9/1994 | Evenson . | |
| 5,368,380 | 11/1994 | Mottmiller et al. . | |
| 5,407,074 | 4/1995 | Brightbill et al. . | |
| 5,433,518 | 7/1995 | Skov . | |

FOREIGN PATENT DOCUMENTS

| | | | |
|---|---|---|---|
| 240424 | 8/1962 | Australia | 312/265.6 |

OTHER PUBLICATIONS

International Search Report completed on Sep. 20, 1996 and mailed on Oct. 8, 1996.

Association of Rotational Molders, *Application For Rotational Molding*, May 1989, pp. 1–3.

Brochure: PDM Molding, Inc.

Brochure: Applications for Rotational Molding.

*Primary Examiner*—Peter M. Cuomo
*Assistant Examiner*—Stephen Vu

[57] ABSTRACT

A molded cabinet assembly for storage of supplies or retail stock, the cabinet assembly including at least two cabinet units; where the cabinet units are adjoined side by side; where each cabinet unit includes: inner and outer polymeric panel surfaces; formed by molding; where panel surfaces form multiple joined panels; and where the panels have at least two side panels, one back panel, and a bottom panel. The panels surround a hollow for containing within the hollow supplies or retail stock and an opening is formed in a front portion of the cabinet unit for access to the for storing supplies or retail stock. The back panel of the cabinet unit has an opening for allowing access to electrical outlets, plumbing, and other resources which may be located behind the cabinet unit. A serving surface is fixedly attached to the upper portions of the side panels and back panel and the top portion of the serving surface for placement of retail food and drink dispensers.

1 Claim, 2 Drawing Sheets

CABINET ASSEMBLY COMPRISING MULTIPLE IDENTICAL MOLDED CABINET UNITS

RELATED APPLICATIONS

This application is a continuation-in-part of patent application Ser. No. 08/473,686, filed Jun. 7, 1995, now U.S. Pat. No. 5,638,032, issued on Nov. 18, 1997 entitled "Storage Cabinet Assembly", which is a continuation-in-part of patent application Ser. No. 08/435,052, filed May 8, 1995, now U.S. Pat. No. 5,688,031, issued on Nov. 18, 1997 entitled "Cabinet Assembly."

FIELD OF THE INVENTION

The invention relates to a polymeric cabinet assembly for containing supplies or retail stock and for providing a counter surface for a work surface or for storage of supplies/retail stock.

BACKGROUND OF THE INVENTION

Retail stores have a need for many types of storage, display, and serving fixtures and areas for the retail goods. Goods must be visibly displayed for the customer's easy access. Extra inventory must be stored until needed. Where the goods are ready-to-eat self-serve food and drink items, a serving surface is necessary for the customer.

Such needs are present, for example, in convenience stores. In a convenience store the customer may, for example, purchase a hot dog and soft drink. These items are typically self-serve. Thus, it is necessary to have a counter top for holding the drink, ice, and cup dispenser, the hot dog rotisserie, and the plates, napkins, table ware, and condiments.

Such a counter top ideally requires only low maintenance, has a long life, and can be readily installed in a variety of floor plan configurations. A modular design is desirable so as to be reduce manufacturing cost. A single piece basic cabinet unit is desirable to reduce assembly problems and to eliminate the irregularities which arise when each cabinet unit requires separate assembly. It would be desirable to have such a counter top also having internal storage capacity for extra supplies and goods. The counter top and associated assembly should be made of an inexpensive material that is durable, easily cleaned, and of light weight. The present invention addresses all of the above problems and provides a cabinet assembly to meet the above discussed needs.

SUMMARY OF THE INVENTION

The invention includes a molded cabinet assembly for storage of supplies or retail stock, the cabinet assembly including at least two cabinet units; where the cabinet units are fixedly adjoined side by side; where each cabinet unit includes: inner and outer polymeric panel surfaces; formed by molding; where panel surfaces form multiple joined panels; and where the panels include at least two side panels, one back panel, and a bottom panel. The panels surround a hollow for containing within the hollow supplies or retail stock and an opening is formed in a front portion of the cabinet unit for access to the hollow for storing supplies or retail stock. The back panel of the cabinet unit has an opening for allowing access to electrical outlets, plumbing, and other resources which may be located behind the cabinet unit. A serving surface is fixedly attached to the upper portions of the side panels and back panel and the top portion of the serving surface may then be used for placement of retail food and drink dispensers.

DETAILED DESCRIPTION OF THE PREFERRED EMBODIMENTS

A. Overview and Benefits

Figure 1:
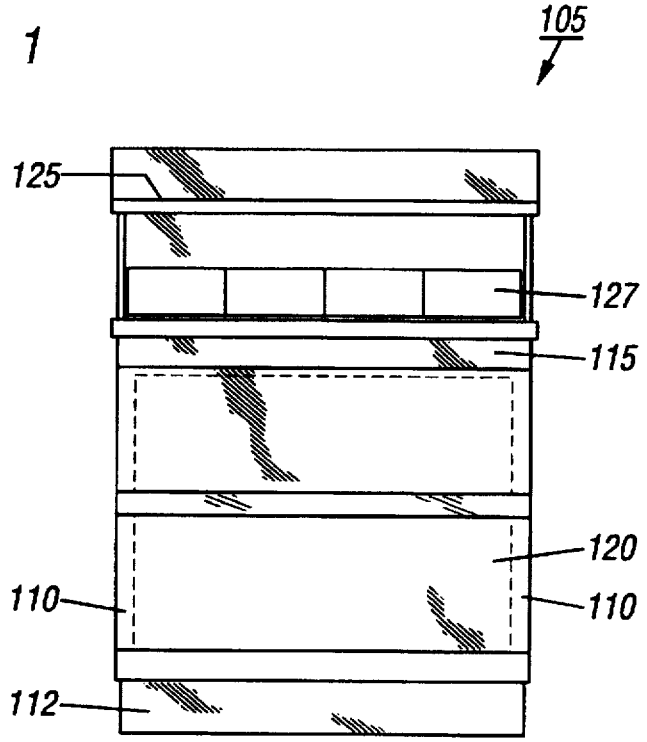
FIG. 1 shows a front view of one embodiment of a single cabinet unit.

The cabinet assembly of the invention is designed to provide a serving surface for food and to provide internal storage space for extra goods and supplies or otherwise for general storage/surface needs. Such uses are practical for example in convenience stores, homes, hospitals, retail stores, laundries, cafeterias, and/or restaurants. The design is modular, meaning there is a common single cabinet unit. The side walls, floor, and back of each cabinet unit is a single piece, self-supporting design requiring no assembly and providing little or no deviation in dimensions between each cabinet unit. These cabinet units can be adjoined or abutted side by side to construct a cabinet assembly of the necessary size for any particular store floor plan. A single piece design also facilitates easy installation and removal or replacement of individual cabinet units. Where adhesive is used for attaching the serving surface, installation and removal can be done without tools, excluding adjustment of the adjustable footings and attachment of the valance.

B. The Components

The cabinet assembly includes the following components.

1. Abutting Cabinet Units

The cabinet assembly includes at least two cabinet units. The cabinet units are abutted side by side or are optionally fixedly adjoined side by side. One side of one cabinet unit abuts one side of the other abutting cabinet unit.

2. Cabinet Unit Design

Each cabinet unit includes an inner polymeric panel surface and an outer polymeric panel surface. These inner and outer polymeric surfaces are either separate polymeric shells or inner and outer wall surfaces of a single polymeric panel. This will depend on the method of manufacture. Rotational molding can be used to produce single or double-walled construction. Double-wall rotational molding, typically, results in separate shells with a lower-density "foam" polymer in between; whereas Reaction Injection Molding, "RIM," results in a single wall panel, optionally, of substantially consistent density both at its inner and outer surfaces and in between the inner and outer surfaces. For further information, RIM is described at 14 Encyclopedia of Polymer Science and Engineering 75 (2nd Ed. 1988). The inner and outer panel surfaces are integrally joined and formed by molding, such as by rotational molding or other molding processes. The inner and outer panel surface are typically separated by a distance of from about 0.5 inches to about one inch and the inner panel surface is typically substantially parallel to the corresponding outer panel surface. The inner and outer panel surfaces form a plurality of integrally joined panels.

3. Panels

The panels include two side panels, one back panel, and one bottom panel. The panels surround and define a hollow for containing within the hollow supplies or retail stock. The serving/work surface will define the top of the hollow. The bottom panel may optionally have threadably adjustable footings attached thereto for leveling the cabinet assembly on an uneven floor surface. The bottom panel optionally has access holes in its top portion for adjustment of the footings. The bottom panel is optionally recessed in a center portion to add structural strength. The front portions of the side panels are optionally notched, such as an L-shaped notch, or recessed for receipt of supplies or retail stock/goods or for receipt of condiment trays and/or a cup dispensor.

4. Front Opening

An opening is formed in a front portion of the cabinet unit, due to absence of a front panel. This opening is for allowing access to the hollow for storing supplies or retail stock. The opening is bounded and defined on its sides by forward edges of each of the side panels and, on the bottom by the front edge of the bottom panel. The opening is typically bounded on the top by the front edge of the serving surface.

5. Valance

A four-sided valance frame is fixedly attached to the circumference of the front opening. The valance frame has two side members and an optionally integrally joined top and bottom member. Thus the valance forms a four-sided frame. It attaches by any conventional means such as an adhesive or screws to the front portions of the side panels and bottom panel. The bottom surface of the top member of the valance and the top surface of the bottom member of the valance are optionally each configured for detachable attachment of a door panel. For example, if a tongue and groove method of attaching the door panel is used then the top member and bottom member surfaces will have grooves for receipt of the corresponding tongue portions on the door panel.

6. Door Panel

A door panel is removably attached, for example, by tongue and groove attachment means, to the bottom surface of the top member of the valance and the top surface of the bottom member of the valance. When attached, the door panel covers the front opening and may be detached for access to goods and supplies stored in the hollow.

7. Back Panel Opening

The back panel of the cabinet unit typically has an opening therein for allowing access to electrical outlets, plumbing, and other resources.

8. Detachable Back Panel Door

A detachable door is optionally removably attached over the opening in the back panel.

9. Internal Shelves

One or more shelves are optionally removably attached to the side walls to span the hollow from side wall to side wall and thereby provide storage shelving as needed to maximize storage capacity. The shelves are attached by any conventional means. Integral ledges for support of shelves are optionally incorporated into the inner side of the side panels.

10. Work/Serving/Storage Surface

A surface is fixedly attached to the upper portions of the side panels, back panel, and top member of the valance frame. The top portion of the serving surface is for placement of supplies or retail stock such as food and drink dispensers or for providing a work surface. The surface may have an optional back restraining panel portion substantially vertical for preventing goods on the serving surface from sliding off the back edge.

C. Molding

The cabinet unit is manufactured by molding. This includes rotational molding, RIM molding, and structural foam molding. Generally, rotational molding involves injection of a powdered or liquid state polymer into a mold. The mold is then heated and rotated around several axes to distribute the powdered polymer. Due to heating, the powdered polymer melts and flows together along the mold thus forming panels conforming to the shape of the mold. A "foam" (i.e., less dense) polymer can optionally be added between the inner and outer panels. The foam can be a separate material from the panels and it can be injected. Alternatively, the "foam" can be formed of the same material as the inner and outer panels. In this process, before all the initial polymer is heat set to form the inner and outer panels, an appropriate chemical additive is injected into the unset polymer which causes it to "foam" and set. For further information, rotational molding is described at 14Encyclopedia of Polymer Science and Engineering 659–670 (2nd Ed. 1988). Other conventional molding techniques are optionally used to manufacture the cabinet assembly of the invention. These include vacuum/pressure forming, injection molding, blow molding compression forming, and match die forming.

D. Assembly and Installation

Various steps may be used in assembling and installing the cabinet assembly. Typically, the desired number of cabinet units are placed in the proper location in the store. They are positioned side by side. Optionally, they may be fixedly attached to each other at the abutting sides. The adjustable footings are then adjusted to account for any unevenness in the flooring. A single serving surface is then installed to lie on the top of the upper portions of the side panels of the multiple cabinet units. A single lower kick panel is then optionally installed at the bottom front portion of the bottom panels. Typically, instead of a single lower kick panel, tiles are layered, by adhesive for example, to the bottom front portion of the bottom panels to give a uniform appearance to this portion of the cabinet assembly. If a condiment tray or drink dispenser is utilized these are then installed along with a transparent sneeze guard, if desired.

VII. DETAILED DESCRIPTION OF THE DRAWINGS

A. FIG. 1

FIG. 1 shows a front view of one embodiment of a single cabinet unit 105. Side panels 110 on the left and right sides extend upward from bottom panel 112. Valence 115 frames the circumference of the opening formed by the forward portions of side panels 110 and bottom panel 112. Door panel 120 is removably attached to valance 115 to cover the opening. Serving surface 125 is fixedly attached to the top portions of side panels 110 and the back panel (not shown in this drawing). Condiment trays 127 are removably positioned on a front portion of serving surface 125.

B. FIG. 2

Figure 2:
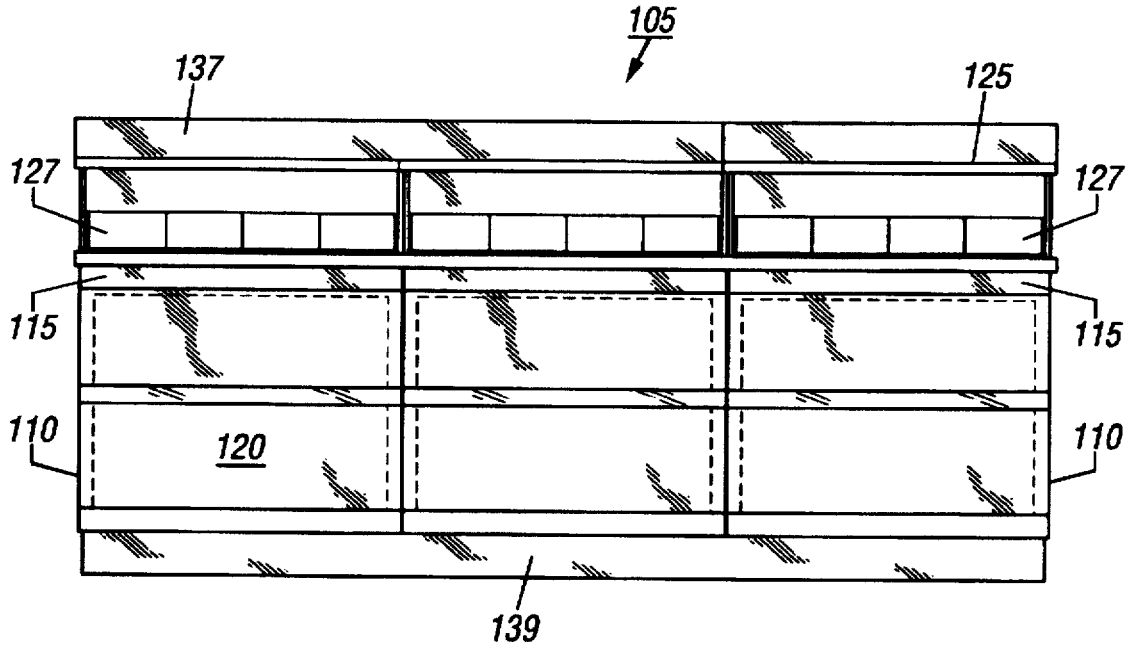
FIG. 2 shows a front view of one embodiment of three cabinet units fixedly adjoined side by side.

FIG. 2 shows a front view of one embodiment of three cabinet units 105 fixedly adjoined side by side. The same numbering is used for the elements of the cabinet units as in FIG. 1. When two or more cabinet units 105 are adjoined side by side the serving surface 125 is optionally a single panel so as to give a smooth continuous counter surface. Similarly, a single kick panel 139 is optionally fixedly attached to the front portions of said bottom panel 112 to provide a continuous appearance. Serving surface 125 optionally has an integral or fixedly attached rear panel 137 along the back portion of serving surface 125 to prevent goods from being pushed off the back of the serving panel 125. Back restraining panel 137 is substantially vertically oriented and may be a single panel when more than one cabinet unit is adjoined side by side.

C. FIG. 3

Figure 3:
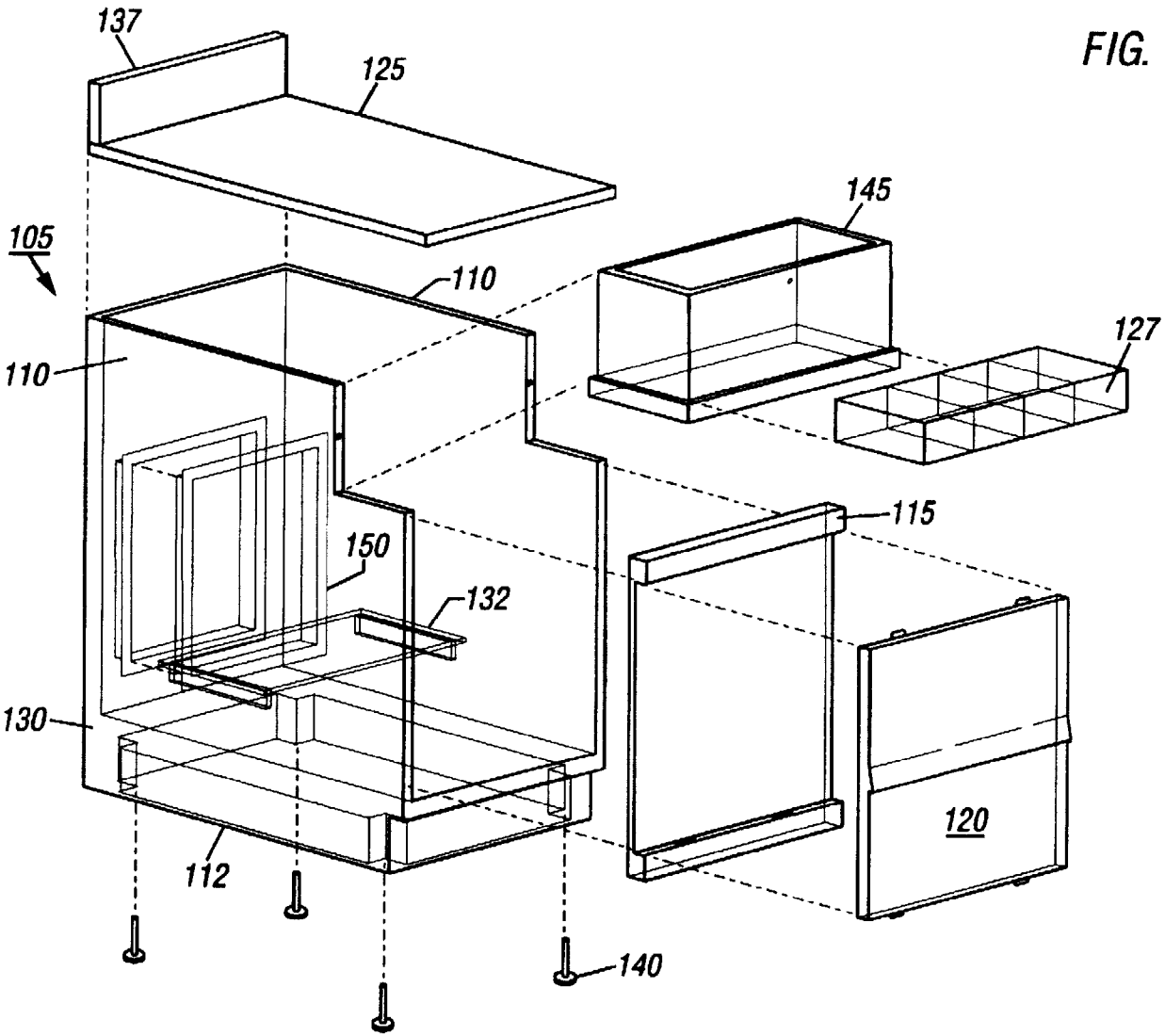
FIG. 3 shows an exploded isometric view of the details of one embodiment of a single cabinet unit.

FIG. 3 shows an exploded isometric view of the details of one embodiment of a single cabinet unit. Only the additional elements not visible in FIGS. 1 or 2 will be described here. Back panel 130 is integrally attached to side panels 110 and bottom panel 112. Back panel 130 has an opening therein for access to utilities in any wall to which the cabinet assembly is placed. Detachable door 150 is optionally removably attached to back panel 130 to be removed to allow access through the opening in back panel 130.

Bottom panel 112, optionally has adjustable footings 140 threadably attached. By rotating the threaded footings to different lengths the cabinet may be stable even on uneven flooring. Sneeze guard 145 is optionally placed over condiment trays 127. The sneeze guard is typically a transparent plastic or glass. Inside the cabinet unit 105, optional shelve 132 is removably attached side walls 110. Various arrangements of shelving are possible to maximize the storage capacity of the cabinet unit.

What is claimed is:

1. A cabinet assembly comprising:

a plurality of molded cabinet units joined side by side, and wherein each of said cabinet units comprises a plurality of polymeric surfaces molded in a unitary construction, said plurality of said surfaces consisting of one bottom surface, one back wall and two side walls; and a top panel fixedly attached to the top edges of said back and side walls of at least one of said cabinet units to thereby define a hollow bounded by said top panel and said bottom surface, said back wall, and said two side walls of said cabinet unit;

wherein said two side walls of said at least one of said cabinet units includes matching L-shaped notches in the top front edges of said two side walls and wherein said matching L-shaped notches are adapted to engage with a removable plug-in unit; and wherein said removable plug-in unit comprises L-shaped flat surfaces which are adapted to engage with said matching L-shaped notches and thereby close the opening formed between said notches.

* * * * *